US008677841B2

(12) United States Patent
Baxter et al.

(10) Patent No.: US 8,677,841 B2
(45) Date of Patent: Mar. 25, 2014

(54) SAMPLE CARRIER FOR SINGLE PHASE SAMPLERS

(75) Inventors: Craig Baxter, Aberdeen (GB); Shankar Bhukya, Aberdeen (GB); Murray Stuart, Aberdeen (GB); Mike Dalgarno, Aberbeen (GB); Philip Hunt, Aberdeen (GB)

(73) Assignee: Proserv UK Limited, Aberdeen (GB)

( * ) Notice: Subject to any disclaimer, the term of this patent is extended or adjusted under 35 U.S.C. 154(b) by 261 days.

(21) Appl. No.: 13/170,678

(22) Filed: Jun. 28, 2011

(65) Prior Publication Data

US 2011/0314936 A1 Dec. 29, 2011

Related U.S. Application Data

(60) Provisional application No. 61/359,276, filed on Jun. 28, 2010.

(51) Int. Cl.
*G01N 1/00* (2006.01)

(52) U.S. Cl.
USPC ..... 73/863

(58) Field of Classification Search
USPC ..... 73/863; 166/164, 264
See application file for complete search history.

(56) References Cited

U.S. PATENT DOCUMENTS

| | | | | |
|---|---|---|---|---|
| 5,337,822 | A | 8/1994 | Massie et al. | |
| 5,609,205 | A | 3/1997 | Massie et al. | |
| 5,901,788 | A | 5/1999 | Brown et al. | |
| 6,439,306 | B1 * | 8/2002 | Patel | 166/264 |

FOREIGN PATENT DOCUMENTS

| | | | |
|---|---|---|---|
| GB | 2252296 | A | 5/1992 |

OTHER PUBLICATIONS

Schlumberger: "Sample Carrier for Single-Phase Bottomhole Samplers" Schlumberger Marketing Communications (Oct. 2006) www.slb.com/welltesting http://geco-prakla.com/services/testing/reservoir_sampling/downhole_sampling/scar_sample_carrier_single_phase.aspx.
Schlumberger: "Downhole Sampling" (2010 Schlumberger Limited) http://gego-prakla.com/services/testing/reservoir_sampling/downhole_sampling.aspx (printed Jun. 3, 2010).
Schlumberger: "Characterize Reservoir Deepwater Fluids" (2010 Schlumberger Limited) http://www.slb.com/services/industry_chalenges/deep_water/characterization/fluid_character.aspx (Printed Jun. 3, 2010).

(Continued)

*Primary Examiner* — Hezron E Williams
*Assistant Examiner* — David Z Huang
(74) *Attorney, Agent, or Firm* — Gary L. Bush; Andrews Kurth LLP

(57) ABSTRACT

An apparatus for carrying well samplers including a tubular carrier housing, a crossover sub connected to the housing, and a pair of adjacent single phase samplers set off from the tool centerline axis thereby providing an offset interspatial through-bore region to support wireline operations. The pair of single phase samplers are removably disposed between upper and lower positioning inserts. The inserts have recessed sampler seats and through-bores that align with the interspatial through-bore region. A conduit fluidly connects one pair of recessed seats to the tool exterior so as to port annulus pressure to the pressure-activated triggering mechanisms of the samplers. A rupture disk housing is removably connected to the triggering conduit from an exterior recess in the crossover sub. The other positioning insert includes a clamping mechanism to removably secure the samplers within the carrier. Multiple assemblies of crossover subs and carrier housing can be connected in tandem.

6 Claims, 4 Drawing Sheets

(56) References Cited

OTHER PUBLICATIONS

Schlumberger: "Single-Phase Multisampler Chamber—Pressure-Compensating Openhole Sampling Tool." (Jan. 2007) www.slb.com/welltesting.
Schlumberger: "Single-Phase Reservoir Sampler—Advanced Sampling System for All Wireline Applications" (Oct. 2006) www.slb.com/welltesting.
Schlumberger: "Slimline Single-Phase Reservoir Sampler." (Mar. 2006) www.slb.com/oilfield.
Halliburton: Armada® Sampling System—Halliburton's innovative tubing conveyed carrier for single-phase downhole sampling, 2009.
Halliburton: T-FAS® SPS Sampler, 2009.
Halliburton: "First North Sea Use of T-FAS® Sampler Helps Apache Model Reservoir Performance" Mitch Elkins, Drilling Superintendent, Apache North Sea Limited, 2009.
Halliburton: "Simba® Tubing-Mounted Single-Phase Fluid Sample Carrier" (Overview) (printed Jun. 3, 2010) http://www.halliburton.com/ps/default.aspx?pageid=4026&propid=MSE::10554492427933330.

* cited by examiner

SAMPLE CARRIER FOR SINGLE PHASE SAMPLERS

CROSS REFERENCE TO RELATED APPLICATION

This application is based upon provisional application 61/359,276 filed on Jun. 28, 2010, which is incorporated herein by reference and the priority of which is claimed.

BACKGROUND OF THE INVENTION

1. Field of the Invention

This invention relates generally to sampling systems for downhole use, such as for sampling well fluids in the oil and gas industry, and in particular to carriers for pressure compensated single phase samplers for use in drill stem testing application.

2. Background Art

Fluids may issue from geologic formations into a well at high pressures and temperatures. To raise these fluids to the well surface for sampling without the fluids undergoing phase change, pressure compensated single phase samplers are used. Such samplers typically include a piston-cylinder sampling chamber and a gas reservoir that supplies high pressure gas to maintain the pressure in the sampling chamber at the sample collection pressure. A rupture disk is used to trigger the operation of the sampler. One example of a single phase sampler is described in the United Kingdom Patent GB 2 252 296, filed on Dec. 5, 1991 by inventors Massie et al. and entitled "Fluid sampling systems," which is incorporated herein by reference. Other samplers are disclosed in U.S. Pat. Nos. 5,609,205 and 5,337,822 issued to Massie et al. and entitled "Well Fluid Sampling Tool," and U.S. Pat. No. 5,901,788 issued to Brown et al. and entitled "Well Fluid Sampling Tool and Well fluid Sampling Method," which are all incorporated herein by reference. Such samplers preferably have a small diameter so that they may be used in wireline operations.

Tubular carriers that are arranged for running multiple single phase samplers into a well are known in the art. Such carriers are used, for example, in conjunction with a drill stem test. Typically, a number of slim single phase samplers are circumpositioned about the circumference of the carrier, leaving a clear through-bore for wireline operations. Two or more samplers may be actuated by annulus pressure using a common rupture disk, if desired. By outfitting one or more of the individual single phase carriers with annulus rupture disk actuators having differing burst pressures, multiple well samples may be taken at different flow periods. Examples of such drill stem test carriers for single phase samplers include Schlumberger's Oilphase DBR SCAR Sample Carrier, Expro's Petrotech SmartCarrier, and Halliburton's Simba and Armada carriers.

It is desirable to use existing single phase samplers in a carrier having an arrangement wherein the maximum outer diameter does not exceed five inches so that the drill stem test carrier may be run into seven inch heavy-walled (38 lb/ft, 0.540 inch wall thickness, 5.920 inch inner diameter) well casing. Although the Schlumberger's Oilphase DBR SCAR Sample Carrier is available in both 5.25 inch and 5.5 inch outer diameter models, each carrying up to eight samplers for a combined sample size of 2400 cc, the samplers are partially enclosed by a cylindrical housing, which subjects the samplers to potential mud entrapment around the sampler inlet ports. Mud entrapment can result in the first portion of the sampled volume being compromised with mud/completion fluids. Expro's Petrotech SmartCarrier is available in a 5.0 inch model that includes four samplers for a combined sample size of 2160 cc. The SmartCarrier sacrifices sample volume to achieve its small diameter. Moreover, the SmartCarrier has a full bore inner diameter of 2.0 inches rather than the 2.25 inch, which is less than desirable for wireline operations. Halliburton's Simba carrier is designed for use within seven inch casing and has a 2.25 inch through bore, but it is limited to two samplers for a combined sample volume of 1200 cc. Finally, Halliburton's Armada sampling system includes a carrier having a 5.375 inch outer diameter, 2.25 inch through bore, and can run up to nine one-inch samplers for a combined sample volume of 3600 cc. The Armada achieves this capability by using a common nitrogen section for servicing all of the samplers. For this reason, the Armada is characterized by considerable potential leak paths and is complicated to manufacture, assemble and test.

3. Identification of Objects of the Invention

A primary object of the invention is to provide a carrier for single phase samplers having a maximum outer diameter of 5.0 inches, a through bore of 2.25 inches, an overall length of approximately 39 feet, and a total sample volume of 2400 cc.

Another object of the invention is to provide a carrier for single phase samplers that may carry up to four single phase samplers.

Another object of the invention is to provide a carrier for single phase samplers that allows for simplified manufacturing assembly and testing.

Another object of the invention is to provide a carrier for single phase samplers that removes the need to machine the casing body of the carrier.

Another object of the invention is to provide a carrier for single phase samplers that reduces potential leak paths by minimizing the need for and number of internal seals within the carrier body.

Another object of the invention is to provide a carrier for single phase samplers that incorporates rupture disks in top and bottom subs.

SUMMARY OF THE INVENTION

The objects described above and other advantages and features of the invention are incorporated in a single phase sampler carrier arrangement including, according to a first embodiment, a housing having a tubular shape, a crossover sub connected to the carrier housing, and a pair of single phase samplers disposed adjacent to one another and set off from the tool centerline axis thereby providing an offset interspatial through-bore region to support wireline operations.

The pair of single phase samplers are removably disposed between upper and lower positioning inserts having recessed seats formed therein. A first of the positioning inserts includes a conduit fluidly connecting the recessed seats to the exterior of the tool so as to port annulus pressure to the pressure-activated triggering mechanisms of the samplers. Preferably, a rupture disk housing is removably connected to the triggering conduit from an exterior recess in the crossover sub. The other of the positioning inserts includes a clamping mechanism to removably secure the samplers within the carrier. Both the upper and lower positioning inserts include offset through-bores that align with the interspatial through-bore region for supporting wireline operations.

Multiple assemblies of crossover subs and carrier housing can be connected in tandem.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
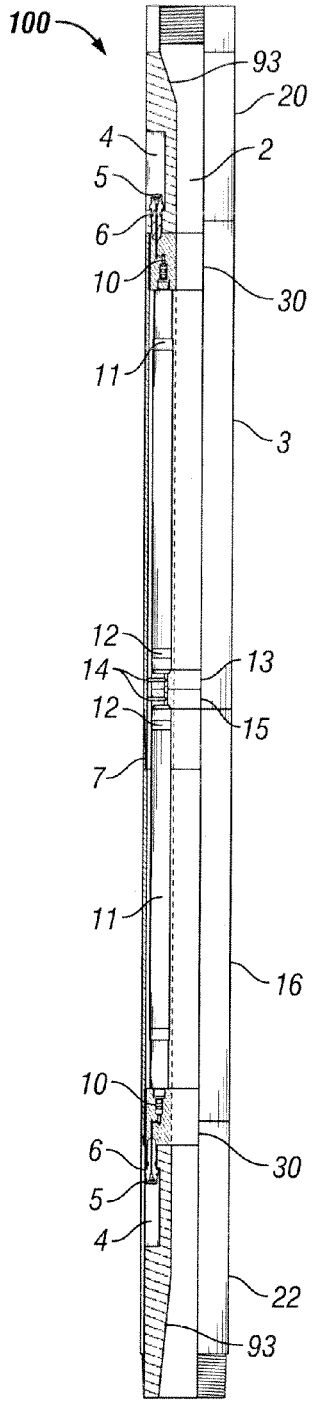
FIG. 1 is a side view in partial cross section of a carrier for single phase samplers according to a preferred embodiment of the invention, showing a top crossover sub with rupture disk, a top carrier housing for carrying up to two single phase samplers, a bottom carrier housing for carrying up to two single phase samplers, and a bottom crossover sub with rupture disk.
Figure 2A:
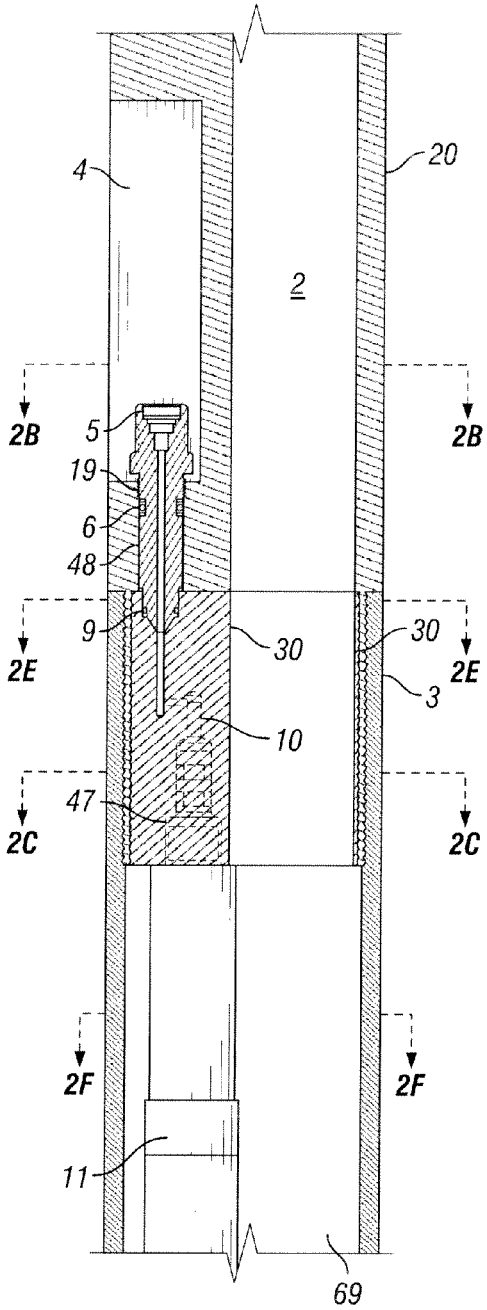
FIG. 2A is a detailed side view in longitudinal cross section of the flush connection between the top crossover sub and the top carrier housing of FIG. 1, showing a rupture disk housing connector positioned in a recess formed in the top crossover sub and a fluid communication path between the rupture disk housing connector and a single phase sampler.
Figure 2B:
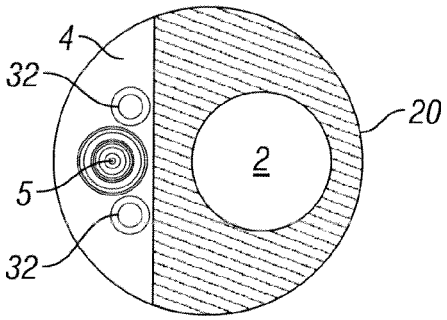
FIG. 2B is a transverse cross-section taken along lines 2B-2B of FIG. 2A through the top crossover sub, showing an offset 2.25 inch through bore for supporting wireline operations and a rupture disk housing opening into an exterior recess.
Figure 2C:
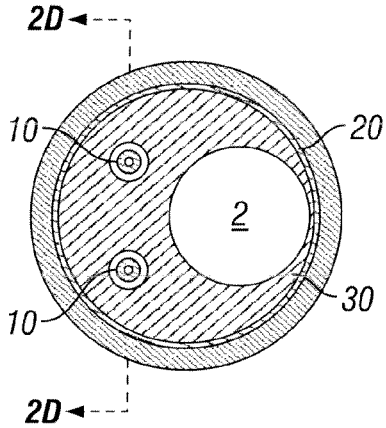
FIG. 2C is a transverse cross-section taken along lines 2C-2C of FIG. 2A through the top carrier housing, top crossover sub, and top distal centralizer insert, showing pressure-activated trigger ends of two upper single phase samplers.
Figure 2D:
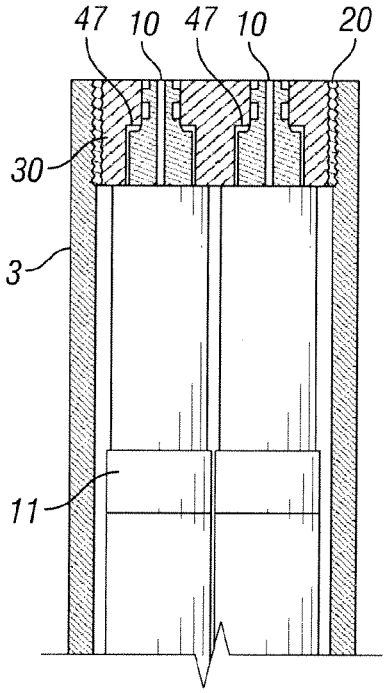
FIG. 2D is a partial longitudinal cross-section taken along lines 2D-2D of FIG. 2C, showing two upper single phase samplers with their pressure-activated trigger ends seated in the upper distal centralizer insert.
Figure 2E:
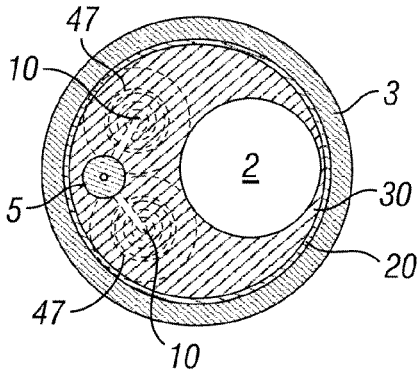
FIG. 2E is a transverse cross-section taken along lines 2E-2E of FIG. 2A, with two upper single phase samplers and a combined triggering conduit shown in hidden line.
Figure 2F:
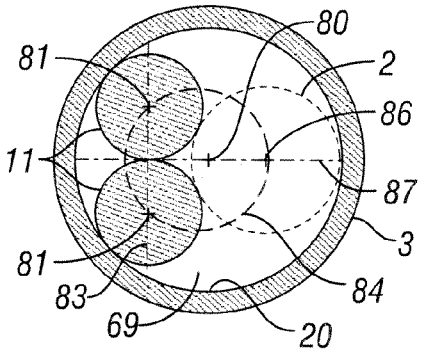
FIG. 2F is a transverse cross-section taken along lines 2F-2F of FIG. 2A, illustrating the geometrical arrangement of the single phase samplers and the through bore of the top distal centralizer insert the with respect to the tool centerline axis according to a preferred embodiment of the invention.

FIGS. 1-4 illustrate a sampler carrier 100 for single phase samplers for use with drill stem testing according to a preferred embodiment of the invention. Sampler carrier 100 has a 5.0 inch maximum diameter, with no external offsets for use with 7 inch 38 lb/ft casing 1. Referring to FIG. 1, carrier 100 includes top and bottom carrier housings 3, 16, respectively that are connected together with a premium flush threaded connection 7. Each carrier housing 3, 16 may carry up to two single phases samplers 11, for example, of the type described in the incorporated Massie et al. GB 2 252 296.

Carrier housings 3, 16 are preferably characterized by 5 inch 18 lb/ft Vam FJL boxes at the upper ends and 5 inch 18 lb/ft Vam FJL pins at the lower ends, although other suitable threads, such as Tenaris Hydril, may be used. Carrier housings 3, 16 are preferably formed of P110 grade material and have an internal diameter of 4.276 inches, which results in a 13,940 psi minimum burst pressure rating, a 13,470 psi minimum collapse pressure rating, and 580,000 pounds minimum yield strength. However, other suitable materials may be used as appropriate. Carrier housings 3, 16 each ideally have a length of 17.5 feet. Although each carrier housing 3, 16 can carry two single phase samplers 11, the arrangement according to one or more embodiments of the invention allows sample carrier 100 to maintain a 2.25 inch diameter through bore 2 to support wireline operations.

A top crossover sub 20 is connected to the top of top carrier housing 3. Likewise a bottom crossover sub 22 is connected to the bottom of bottom carrier housing 16. Top and bottom crossover subs 20, 22 carry the rupture disk housings 5 used to actuate the samplers 11 in the top and bottom carrier housings 3, 16, respectively, as described below. Additionally, top and bottom crossover subs 20, 22 act as fairleads 93 for wireline operations and accordingly may have a larger wall thickness than the adjacent carrier housings.

Like carrier housings 3, 16, crossover subs 20, 22 have no external offsets and are also P110 grade with 5 inch 18 lb/ft Vam FJL boxes at the upper ends and 5 inch 18 lb/ft Vam FJL pins at the lower ends. Crossover subs 20, 22 each have a length of 2.0 feet. Crossover subs 20, 22 each include a 2.25 inch diameter through bore 2 to support wireline operations.

Figure 3:
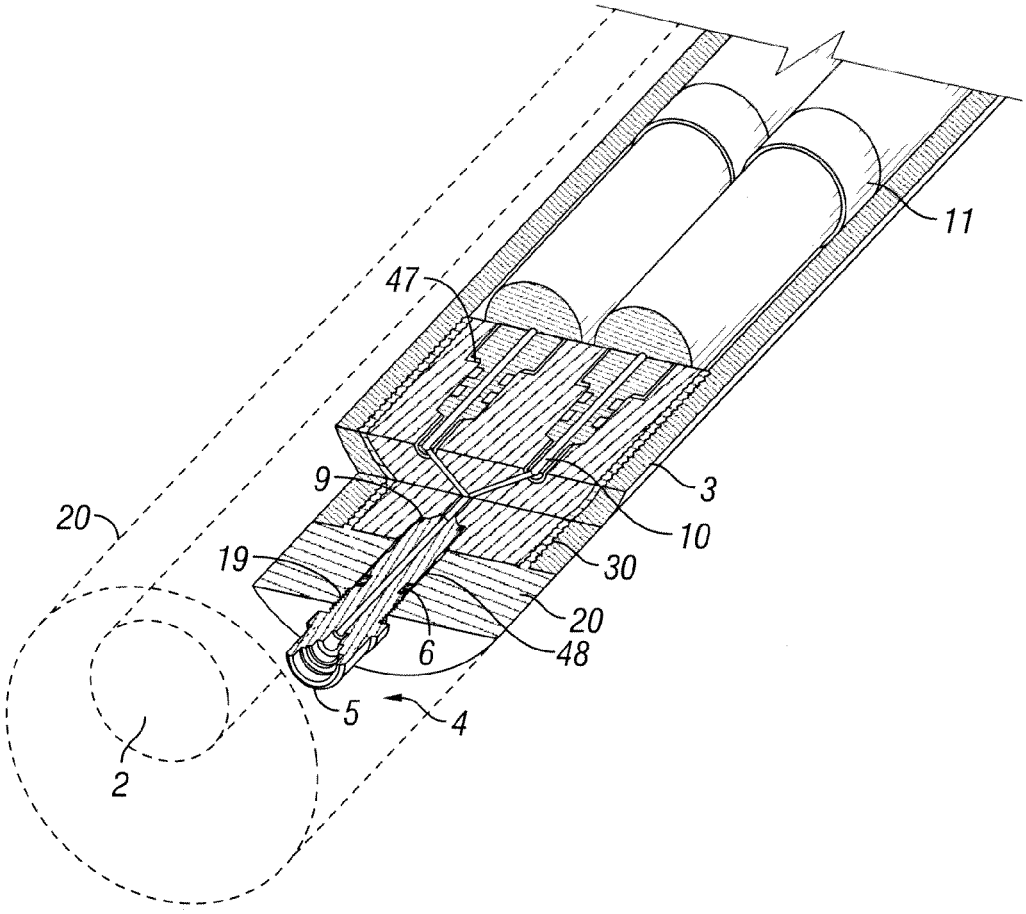
FIG. 3 is a partially cut away perspective view of the distal centralizing insert and annulus firing mechanism according to a preferred embodiment.

FIGS. 2-3 illustrate the top annulus firing mechanism for the top samplers. The bottom firing mechanism for the bottom samplers is identical except for an inverted orientation. Each carrier housing 3, 16 includes a distal centralizer or positioning insert or member 30. Distal positioning insert 30 includes a 2.25 inch bore formed therethrough and fits within the inside diameter at the distal end of the respective carrier housing 3, 16. Formed within the medial end of each distal centralizer 30 are two seats or recesses 47 into which the pressure-activated trigger end of each sampler 11 is seated. Each sampler recess is in fluid communication with a conduit 10 that in turn connects to a common bore 48 into which the medial end of a rupture disk housing 5 is received. A seal 9, such as an o-ring seal, seals the rupture disk housing 5 to conduit 10 within distal positioning member 30.

Top and bottom crossover subs 20, 22 each include a groove or other recesses 4 milled or otherwise formed in the exterior wall. The medial end of groove 4 includes a threaded bore 48 for receiving the rupture disk housing 5. The rupture disk housing is received into groove 4 and inserted into bore 48 so that its medial end is received into conduit 10 as described above. A seal 6, such as an o-ring seal, seals between rupture disk housing 5 and its respective crossover sub 20, 22. Threads 19 near the distal end of rupture disk housing 5 secure the rupture disk housing with the threaded bore 48 of the crossover sub 20, 22.

Rupture disk housing 5 includes a replaceable rupture disk. Rupture disks are selected so that the burst pressure corresponds to the annulus pressure at which sampling is desired. In the preferred embodiment, one rupture disk actuates both samplers in each carrier housing, which causes both samplers 11 to sample at sample ports 12 as described in Massie et al. GB 2 252 296. However, individual triggering may be accommodated if desired.

Although the sampler is described using distal positioning inserts 30, other means to longitudinally support the single phase samplers 11 and to communicate actuation pressure from rupture disk housings 5 to the samplers 11 may be used as appropriate. However, the disclosed arrangement has an advantage of minimizing potential leak paths by limiting the seals required within the carrier body to those at the rupture disk housing 5.

Figure 4:
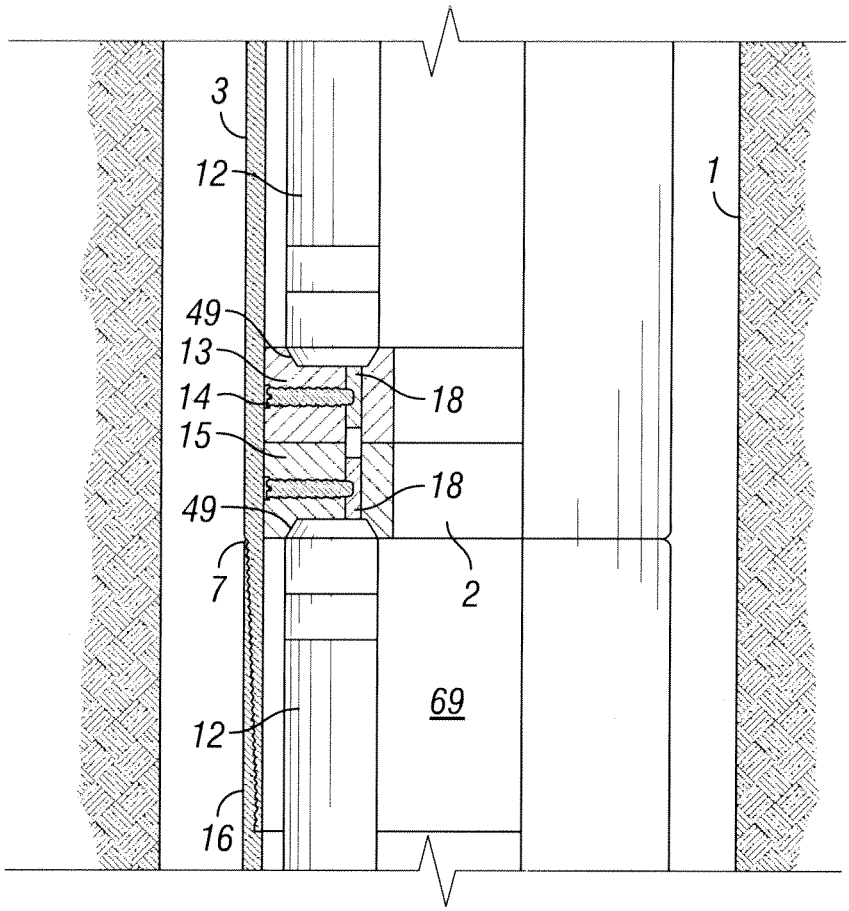
FIG. 4 is a detailed side view in partial cross section of the upper and lower medial centralizing inserts of FIG. 1.

FIG. 4 illustrates the connection between the top carrier housing 3 and the bottom carrier housing 16. Top and bottom medial centralizers or positioning inserts or members 13, 15, respectively, fit within the inside diameter at the bottom end of top carrier housing 3. Top medial positioning insert 13 includes two adjacent seats or recesses 49 (only one is visible in FIG. 4) formed within its top end for receiving samplers 11. Likewise, bottom medial positioning insert 15 includes two adjacent seats or recesses 49 (only one is visible in FIG. 4) formed within its bottom end for receiving samplers 11. Positioning inserts 13, 15 include screw-operated adjusters for releasably locking samplers 11 into carrier 100. For example, a tapered setscrew 14 engages a longitudinally-oriented pin 18 for forcing the pin into engagement with the sampling end of sampler 11, which in turn forces the trigger end of the sampler 11 into tight engagement with the recess 48 formed in distal positioning insert 30 (FIGS. 2-3) when the sampler carrier 100 is fully assembled. However, other clamping mechanisms may be used as appropriate.

Referring back to FIG. 2F, samplers 11 are disposed offset a distance from the tool centerline axis 80 within carrier housing 3, 16. An interspatial through-bore region 69 is defined within carrier housing 3, 16 and outside the pair of samplers 11. Bore 2 (FIGS. 2A-2C, 2E) aligns with the interspatial through-bore region 69 of carrier housing 3, 16. That is, bore 2 is also set off from the tool centerline axis 80 but in the opposite direction that the samplers are set off.

Each sampler 11 is characterized by a longitudinal axis 81. Within each carrier housing 3, 16, the two samplers are positioned adjacent to one another, with their longitudinal axes 81 intersecting an imaginary chord 83. More preferably, the pair of sampler longitudinal axes 81 also intersect the circumference of an imaginary circle 84 centered on the tool centerline axis 80 so that samplers 11 are symmetrically positioned along chord 83.

Within the distal positioning inserts 30, the medial positioning inserts 13, 15, and the medial portions of the crossover subs 20, 22, through bore 2 is positioned essentially tangent with samplers 11 and the interior of crossover sub 20, 22. The centerline 86 of through bore 2 preferably lies along an imaginary line 87 that passes through the tool centerline 80 and bisects chord 83.

Referring back primarily to FIG. 1, sample carrier 100 may be assembled as follows: The upper crossover sub 20 is threaded onto upper carrier housing 3. A first pair of samplers 11 is seated between a distal positioning insert 30 and top medial positioning insert 13, and this assembly is slid into upper carrier housing from the bottom and rotated as necessary to align the annulus firing mechanism. An upper rupture disk housing 5 is then screwed into socket 48 from recess 4. Next, lower carrier housing 16 is threaded onto the lower end of upper carrier housing 3. A second pair of samplers is seated between bottom medial positioning insert 15 and a distal positioning insert 30. This assembly is slid into lower carrier housing 16 and rotated into alignment. Bottom crossover sub 22 is thereafter threaded onto the lower end of lower carrier housing 16. Finally, a lower rupture disk housing 5 is then screwed into socket 48 from recess 4, and sample carrier 100 is ready for sampling.

Although sampler carrier 100 is described as having symmetrical top and bottom halves, if preferred, a carrier having only one carrier housing and crossover sub with a maximum of two single phase samplers may be used according to an alternate embodiment of the invention. Alternatively, a single carrier may be used with top and bottom crossovers. According to another embodiment, more than two carrier housings may be used.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. An apparatus (100) for carrying a plurality of samplers comprising:

a first carrier housing (3) having a tubular shape defining first and second ends;

a first crossover sub (20) connected to said first end of said first carrier housing;

a first sampler (11) received and clamped within said first carrier housing, said first sampler having a pressure-activated trigger mechanism; and a first rupture disk housing (5) including therein a first rupture disk separating first and second ends of said first rupture disk housing, said first rupture disk housing disposed at least partially within a first exterior recess (4) formed within said first crossover sub, said first end of said first rupture disk housing being in fluid communication with the exterior of said apparatus, said second end of said first rupture disk housing being in fluid communication with said trigger mechanism of said first sampler;

wherein a first predetermined pressure at said exterior of said apparatus will rupture said first rupture disk for triggering said first sampler and comprising, a second sampler (11) received and clamped within said first carrier housing (3) adjacent to said first sampler (11), said second sampler having a pressure-activated trigger mechanism, said second end of said first rupture disk housing (5) being in fluid communication with said trigger mechanism of second sampler;

wherein said first predetermined pressure at said exterior of said apparatus will rupture said first rupture disk for triggering both said first and second samplers and further comprising, a first positioning insert (30) disposed in at least one from the group consisting of said first carrier housing (3) and said first crossover sub (20);

a socket (48) formed in said first positioning insert, said second end of said first rupture disk housing being received within said socket;

a recessed seat (47) formed in said first positioning insert, a first end of said first sampler (11) being received within said recessed seat; and a conduit (10) formed within said first positioning insert fluidly connecting said socket to said recessed seat.

2. The apparatus (100) of claim 1 further comprising:

a second carrier housing (16), having a tubular shape defining first and second ends, said first end of said second carrier housing connected to said second end of said first carrier housing (3);

a second crossover sub (22) connected to said second end of said second carrier housing;

a third sampler (11) received and clamped within said second carrier housing, said third sampler having a pressure-activated trigger mechanism;

a fourth sampler (11) received and clamped within said second carrier housing adjacent to said third sampler, said fourth sampler having a pressure-activated trigger mechanism;

a second rupture disk housing (5) including therein a second rupture disk separating first and second ends of said second rupture disk housing, said second rupture disk housing disposed at least partially within a second exterior recess (4) formed within said second crossover sub, said first end of said second rupture disk housing being in fluid communication with said exterior of said apparatus, said second end of said second rupture disk housing being in fluid communication with said trigger mechanisms of said third and fourth samplers;

wherein a second predetermined pressure at said exterior of said apparatus will rupture said second rupture disk for triggering said third and fourth samplers.

3. The apparatus (100) of claim 1 wherein:

said first rupture disk housing (5) is threaded to said first crossover sub (20); and said first crossover sub is threaded to said first carrier housing (3).

4. The apparatus (100) of claim 1 wherein:

said socket (48) is accessible from the exterior of said first crossover sub; and said second end of said first rupture disk housing(5) is removably received within said socket.

5. An apparatus (100) for carrying a plurality of samplers comprising:

a first carrier housing (3) having a tubular shape defining first and second ends;

a first crossover sub (20) connected to said first end of said first carrier housing:

a first sampler (11) received and clamped within said first carrier housing, said first sampler having a pressure-activated trigger mechanism; and a first rupture disk housing (5) including therein a first rupture disk separating first and second ends of said first rupture disk housing, said first rupture disk housing disposed at least partially within a first exterior recess (4) formed within said first crossover sub, said first end of said first rupture disk housing being in fluid communication with the exterior of said apparatus, said second end of said first rupture disk housing being in fluid communication with said trigger mechanism of said first sampler and further comprising:

a second sampler (11) received and clamped within said first carrier housing (3) adjacent to said first sampler (11), said second sampler having a pressure-activated trigger mechanism, said second end of said first rupture disk housing (5) being in fluid communication with said trigger mechanism of second sampler;

wherein said first predetermined pressure at said exterior of said apparatus will rupture said first rupture disk for triggering both said first and second samplers and further comprising, a first positioning insert (30) disposed in at least one from the group consisting of said first carrier housing (3) and said first crossover sub (20), a socket (48) formed in said first positioning insert (30), said second end of said first rupture disk housing (5) being received within said socket (48), a first recessed seat (47) formed in said first positioning insert, (30) with a first end of said first single phase sampler (11) being received within said first recessed seat (47), a second recessed seat (47) formed in said first positioning insert, (30) with a first end of said second single phase sampler (11) being received within said second recessed seat (30), conduits (10) formed within said first positioning insert fluidly connecting said socket to said first and second recessed seats.

6. The apparatus (100) of claim 5 further comprising:

a bore (2) formed through said first positioning insert (30); wherein said first positioning insert has a circular shape defining a tool centerline (80) and an imaginary chord (83);

said first and second samplers (11) define first and second axes (81) that intersect said imaginary chord and the circumference of an imaginary circle (84) centered at said tool centerline; and said bore is centered along an imaginary line (87) that passes through said tool centerline and bisects said imaginary chord.

* * * * *